US006982692B2

(12) United States Patent
Kim

(10) Patent No.: US 6,982,692 B2
(45) **Date of Patent: *Jan. 3, 2006**

(54) LIQUID CRYSTAL DISPLAY AND A METHOD FOR DRIVING THE SAME

(75) Inventor: Dong-Gyu Kim, Suwon (KR)

(73) Assignee: Samsung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 596 days.

(21) Appl. No.: 09/164,392

(22) Filed: Sep. 30, 1998

(65) Prior Publication Data

US 2001/0015716 A1 Aug. 23, 2001

(30) Foreign Application Priority Data

Sep. 30, 1997 (KR) ..... 97-49956

(51) Int. Cl.
*G09G 3/36* (2006.01)

(52) U.S. Cl. ..... 345/96; 345/88; 345/103

(58) Field of Classification Search ..... 345/87–90, 345/92, 94–96, 103, 204, 208–210, 98, 58, 345/598, 694, 209
See application file for complete search history.

(56) References Cited

U.S. PATENT DOCUMENTS

| | | | | | |
|---|---|---|---|---|---|
| 4,986,637 | A | * | 1/1991 | Yamaguchi | 345/88 |
| 5,107,353 | A | * | 4/1992 | Okumura | 359/55 |
| 5,604,358 | A | * | 2/1997 | Kim | 257/59 |
| 5,648,793 | A | * | 7/1997 | Chen | 345/96 |
| 5,654,733 | A | * | 8/1997 | Chimura et al. | 345/96 |
| 5,724,057 | A | * | 3/1998 | Kimura et al. | 345/89 |
| 5,748,268 | A | * | 5/1998 | Kalmanash | 345/90 |
| 5,790,092 | A | * | 8/1998 | Moriyama | 345/96 |
| 5,847,687 | A | * | 12/1998 | Hirakata et al. | 345/96 |
| 5,892,494 | A | * | 4/1999 | Kimura et al. | 345/96 |
| 5,923,310 | A | * | 7/1999 | Kim | 345/90 |
| 6,172,662 | B1 | * | 1/2001 | Ito et al. | 345/94 |
| 6,243,062 | B1 | * | 6/2001 | den Boer et al. | 345/91 |
| 6,243,064 | B1 | * | 6/2001 | Hirakata | 345/96 |
| 6,295,043 | B1 | * | 9/2001 | Hashimoto et al. | 345/96 |
| 6,342,876 | B1 | * | 1/2002 | Kim | 345/87 |

FOREIGN PATENT DOCUMENTS

| | | |
|---|---|---|
| JP | 6-35415 | 2/1994 |
| JP | 6-161392 | 6/1994 |

* cited by examiner

*Primary Examiner*—Regina Liang
(74) *Attorney, Agent, or Firm*—McGuireWoods LLP

(57) ABSTRACT

Disclosed is a liquid crystal display and a method for driving the same. In the method, the data voltage representing image signals are applied to a plurality of pixels arranged in columns and rows, and the polarity of the data voltage for common voltage inverts the pixel groups comprised of two or more pixels. The inventive LCD includes a substrate, a plurality of gate lines formed on the substrate, a plurality of data lines insulated from and intersecting the gate lines, and a plurality pixels formed corresponding to respective regions defined by the data lines and gate lines. Common voltage is applied to the plurality of pixels, and the polarity of the data voltage for the common voltage inverts in units of pixel groups comprised of two or more pixels.

21 Claims, 7 Drawing Sheets

LIQUID CRYSTAL DISPLAY AND A METHOD FOR DRIVING THE SAME

BACKGROUND OF THE INVENTION (a) Field of the Invention

The present invention relates to a liquid crystal display (LCD). More particularly, the present invention relates to an LCD and a method for driving the same that eliminates a brightness difference between adjacent pixels caused by coupling capacitance between pixel electrodes of an LCD panel and adjacent data lines, through a signal process of data voltage, and that prevents pixel defects caused by shortening one or two pixels.

(b) Description of the Related Art

LCDs are increasingly being used for the display device in televisions, personal computers, projection-type displays, etc. LCDs are significantly lighter in weight and slimmer, and consume far less energy than the previous-generation cathode-ray tube displays.

LCDs apply an electric field to liquid crystal material having anisotropic dielectricity and injected between two substrates, an array substrate and a counter substrate, arranged substantially parallel to one another with a predetermined gap therebetween, and control the amount of light permeating the substrates by controlling an intensity of the electric field to obtain a desired image signal.

Formed on the array substrate are a plurality of gate lines disposed parallel to one another, and a plurality of data lines insulated from and crossing the gate lines. A plurality of pixel electrodes are formed corresponding to respective regions (hereinafter referred to as "pixel") defined by the data lines and gate lines. Further, a thin film transistor (TFT) is provided near each of the intersections of the gate lines and the data lines. Each pixel electrode is connected to a data line via a corresponding TFT, the TFT serving as a switching device therebetween.

Each TFT has a gate electrode, drain electrode, and a source electrode. The gate electrode is connected to one of gate lines, and the source electrode is connected to one of data lines and the drain electrode is connected to one of pixel electrodes. Common electrodes are disposed on either the array substrate or the counter substrate.

The operation of the LCD panel structured as in the above will be described hereinafter.

First, after gate ON voltage is applied to the gate electrodes connected to one of the gate lines to turn on the TFTs, data voltage representing image signals is applied to the source electrodes via the data lines such that the data voltage is applied to the pixel electrodes through TFT channels, and an electric field is created by a potential difference between the pixel electrodes and the common electrodes. The electric field intensity is controlled by a level of the data voltage, and the amount of light permeating the substrates is determined by the electric field intensity.

In the above, as the liquid crystal material degrades if the electric field is applied to the liquid crystal material continuously in the same direction, the direction in which the electric field is applied must be constantly changed. Namely, pixel electrode voltage (data voltage) alternates between positive and negative values against the common electrode voltage.

Such a switching of electrode voltage values between positive and negative values is referred to as an inversion driving method. Among the different types of inversion driving methods are frame inversion, line inversion, dot inversion, and column inversion.

In frame inversion, a polarity of pixel electrode voltage for the common electrode voltage changes per frame. However, converting pixel electrode voltage polarity per frame may cause aresidual image or a flicker. In line inversion, the polarity of pixel electrode voltage against the common electrode voltage changes per each horizontal cycle. However, in the line inversion method, the coupling capacitance between the data lines and common electrodes, and the coupling capacitance between the pixel electrodes and common electrodes cause a voltage fluctuation, which results in a crosstalk.

Because of these drawbacks, the dot inversion mode and the column inversion mode are now more commonly used in LCDs.

FIGS. 1*a* and 1*b* respectively show the prior art dot inversion driving method and the prior art column inversion driving method. In the drawings, (+) indicates positive pixel voltage against the common voltage, while (−) indicates negative pixel voltage against the common voltage.

As shown in FIG. 1*a,* polarities of any two adjacent pixels are different in the dot inversion driving method, while in the column inversion driving method, as shown in FIG. 1*b,* pixels having like polarities are arranged in the same column, with the polarities of the columns alternating from positive to negative.

In the above dot and column inversion drive methods, when the pixels in each row refresh, the number of pixels applied to data voltage having a positive polarity is the same as the number of pixels applied to data voltage having a negative polarity. Accordingly, the coupling capacitance between the data lines and common electrodes and the coupling capacitance between the pixel electrodes and common electrodes may not cause voltage fluctuations.

However, while the above-described dot and column inversion driving methods may appear to work well in theory, in reality there are misalignment and variations in the widths of electrodes and data lines. As a result, coupling capacitances between the pixel electrodes and adjacent data lines are not necessasrily similar.

FIG. 2 shows a view illustrating misalignment between pixel electrodes and data lines in the prior art inversion driving methods shown in FIGS. 1*a* and 1*b*. Such misalignment and differences in widths generally occur when the substrates are separated and divided into a plurality of spheres for the patterning process.

In the drawing, Pa and Pb are pixel electrodes, disposed adjacent to but separated from one another, and Vp-a and Vp-b are voltage signals for the pixel electrodes Pa and Pb, respectively. Here, voltage signal Vp-a applies negative voltage against common electrode voltage, while voltage signal Vp-b applies positive voltage.

Although it is designed for the pixel electrodes Pa and Pb to have identical distances from data lines D1, D2, and D3, this is not the case with the actual resulting pattern as the distances between the data lines D1, D2, and D3 and the pixel electrodes Pa and Pb become dissimilar from misalignment and differences in widths of these elements. Because of this variation in distances, coupling capacitance values between the pixel electrodes Pa and Pb, and the data lines D1, D2, D3, and D4 differ.

For example, if the pixel electrode Pa is disposed slightly to the left (in the drawing), while the pixel electrode Pb is disposed slightly to the right (in the drawing), the following results in their coupling capacitance values: Ca-d1>Ca-d2 and Cb-d2<Cb-db3. Here, Ca-d1 and Ca-d2 are the coupling capacitances between the pixel electrode Pa and the data lines D1 and D2, respectively, and Cb-d2 and Cb-d3 are the coupling capacitances between the pixel electrode Pb and the data lines D2 and D3, respectively.

FIG. 3 shows an equivalent circuit diagram for demonstrating influence given to the pixel electrode Pa by voltage fluctuations Vd1 and Vd2 of the data lines D1 and D2, respectively, and the coupling capacitances Ca-d1 and Ca-d2. In the drawing, Vp indicates voltage of the pixel electrode Pa, and Cl indicates liquid crystal capacitance. Here, common electrode voltage is indicated by the grounded level in the drawing as it is a constant value, and storage capacitance is not considered to simplify the circuit analysis. The following formula is established for such a circuit using the law of conservation of charge:

$$(V_{d1} - V_p) * C_{a-d1} + (V_{d2} - V_p) * C_{a-d2} = C_l * V_p$$

$$\text{Accordingly, } V_p = \frac{V_{d1} * C_{a-d1} + V_{d2} * C_{a-d2}}{C_{a-d1} + C_{a-d2} + C_l}$$

As liquid crystal capacitance is generally much larger than coupling capacitance, the above formula is simplified to an approximate formula as in the following:

$$V_p = \frac{V_{d1} * C_{a-d1} + V_{d2} * C_{a-d2}}{C_1}$$

As can be seen with the above formula, Vp is influenced more by the data voltage with the larger coupling capacitance.

FIG. 4 shows a view illustrating fluctuations in voltage with respect to time when dot or column inversion drive is performed on the pattern shown in FIG. 2.

Since Ca-d1>Ca-d2 as described above, more influence is given by Vd1 than Vd2, and, accordingly, Vp-a is pulled toward a voltage side of Vd1. Further, as Cb-d2<Cb-d3, more influence is given by Vd3 than Vd2 such that Vp-b is pulled toward a voltage side of Vd3.

Namely, in FIG. 4, although an original value of Vp-a should be uniformly smaller than the common voltage as can be seen by the dotted line in the drawing, it is in actual application pulled toward Vd1 by the coupling capacitance. In the same way, although an original value of Vp-b should be uniformly larger than the common voltage, it is pulled toward Vd3.

Accordingly, a root mean square (RMS) of Vp-a becomes smaller than an original value, while a RMS of Vp-b becomes greater than an original value such that the brightness of the two pixels changes.

Further, as shown in FIG. 5*a*, according to the prior art dot and column inversion driving methods, Vp-a becomes a negative value against common voltage (Vcom), and Vp-b becomes a positive value in a normal state such that a black state is displayed. However, as shown in FIG. 5*b*, if two adjacent electrodes are shortened, Vp-a and Vp-b become an average value of two voltages to become similar to the common voltage, resulting in the two pixels constantly displaying a white state, indicating defective pixels.

SUMMARY OF THE INVENTION

The present invention has been made in an effort to solve the above problems.

It is an object of the present invention to provide a liquid crystal display and a method for driving the same in which a difference in brightness between adjacent pixels, caused by coupling capacitance between pixel electrodes of an LCD panel and adjacent data lines, is removed by a signal process of data voltage, and in which pixel defects caused by the shortening of one or two pixels is prevented.

To achieve the above object, the present invention provides a liquid crystal display and a method for driving the same. In the method, the data voltage representing image signals are applied to a plurality of pixels arranged in columns and rows, and the polarity of the data voltage against common voltage inverts in units of the pixel groups comprised of two or more pixels.

The inventive LCD includes a substrate, a plurality of gate lines formed on the substrate, a plurality of data lines insulated from and intersecting the gate lines, and a plurality pixels formed corresponding to respective regions defined by the data lines and gate lines.

Common voltage is applied to the plurality of pixels, and the polarity of the data voltage against the common voltage inverts in units of pixel groups comprised of two or more pixels.

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

A preferred embodiment of the present invention will now be described in detail with reference to the accompanying drawings.

Figure 1A:
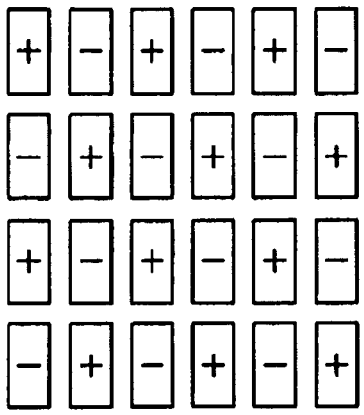
FIG.1A(Prior Art)
FIG. 1*a* is a view of the conventional dot inversion driving method.
Figure 1B:
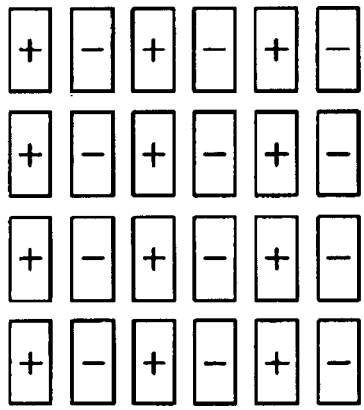
FIG.1B(Prior Art)
FIG. 1*b* is a view of the conventional column inversion driving method.
Figure 2:
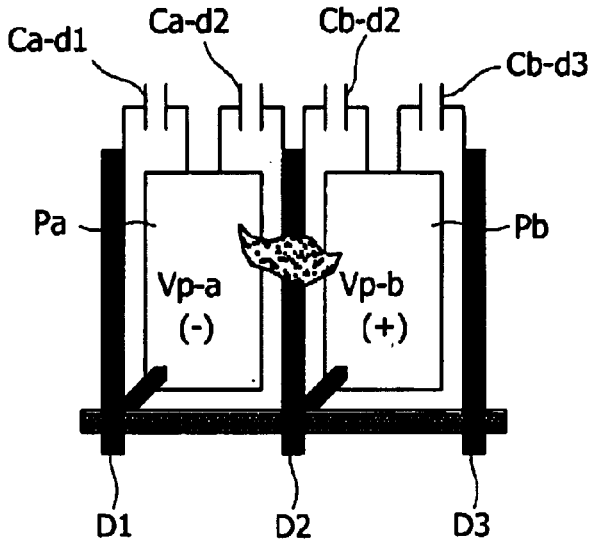
FIG.2(Prior Art)
FIG. 2 is a view illustrating misalignment between pixel electrodes and data lines in the prior art inversion driving methods shown in FIGS. 1*a* and 1*b;*
Figure 3:
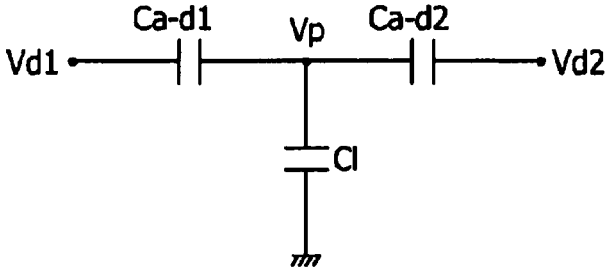
FIG.3(Prior Art)
FIG. 3 is an equivalent circuit diagram for demonstrating influence given to a pixel electrode by voltage fluctuations and coupling capacitance.
Figure 4:
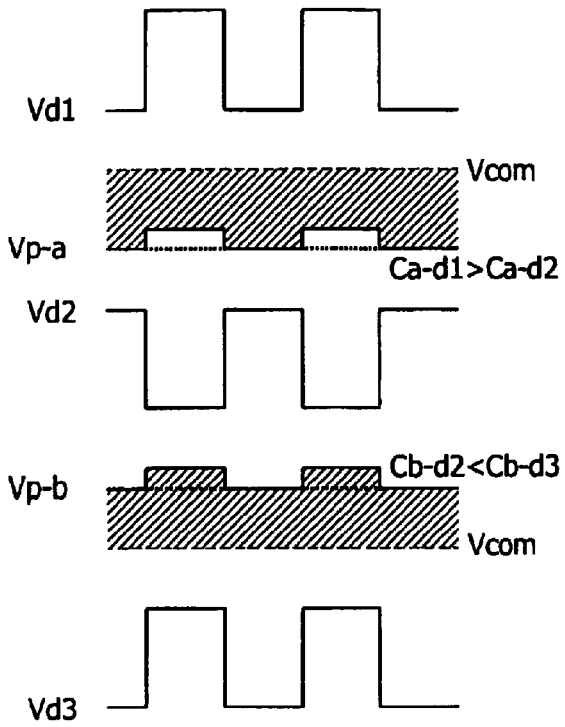
FIG.4(Prior Art)
FIG. 4 is a view illustrating fluctuations in voltage with respect to time when the pattern shown in FIG. 2 is dot or column-inversion driven.
Figure 5A:
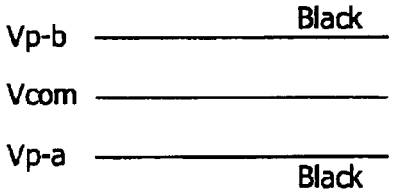
FIG.5A(Prior Art)
FIG. 5*a* is a view illustrating data voltage applied to pixels shown in FIG. 2 when the same are in a normal state.
Figure 5B:
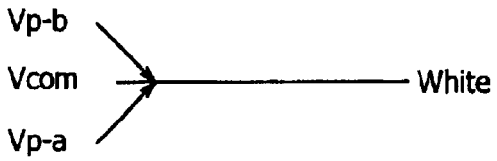
FIG.5b(Prior Art)
FIG. 5*b* is a view illustrating data voltage applied to the pixels shown in FIG. 2 when the same have been shortened.
Figure 6A:
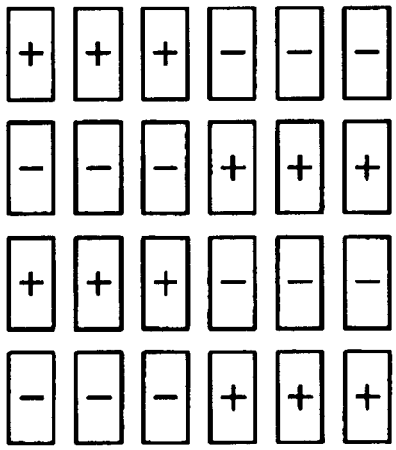
FIGS. 6*a* and 6*b* are views illustrating inversion driving methods according to a preferred embodiment of the present invention.
Figure 6B:
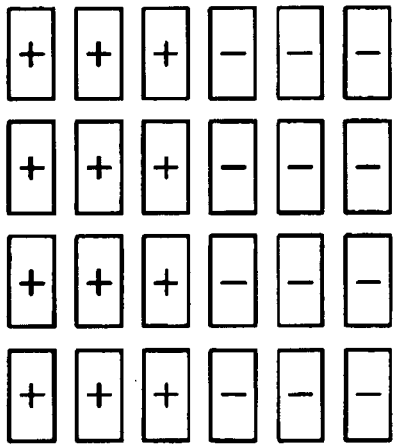

FIGS. 6*a* and 6*b* show views illustrating inversion driving methods according to a preferred embodiment of the present invention.

As shown in FIG. 6*a,* polarities of pixels for common voltage are inverted in units of pixel groups comprised of three pixels in each row for common voltage, and alternate between positive and negative in each column. The pixels in the pixel group are red (R), green (G), and blue (B) pixels, respectively. The inventive LCD is operated like the dot inversion method such that the pixels are driven in units of RGB pixel groups.

In FIG. 6*b,* the polarities of the pixels for common voltage are identical in each column but are inverted by a pixel group comprising three pixels. That is, the LCD operates like the column inversion method such that the RGB pixel groups are driven like a column.

Figure 7:
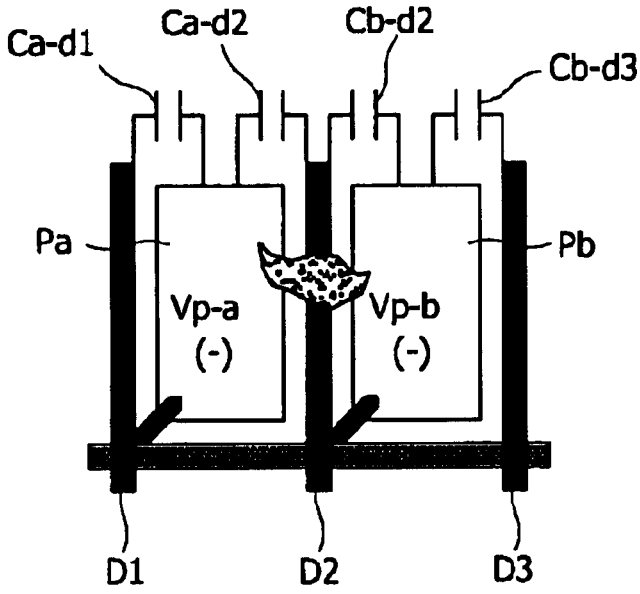
FIG. 7 is a view illustrating misalignment between pixel electrodes and data lines in the inversion driving methods shown in FIGS. 6*a* and 6*b;*

FIG. 7 shows a view illustrating misalignment between pixel electrodes and data lines in the inversion driving methods shown in FIGS. 6*a* and 6*b*.

In the drawing, Pa and Pb are pixel electrodes, disposed adjacent to but separated from one another, and Vp-a and Vp-b are voltage signals for the pixel electrodes Pa and Pb, respectively. Here, voltage signals Vp-a and Vp-b apply negative voltages.

In the above, if the pixel electrode Pa is disposed slightly to the left (in the drawing), while the pixel electrode Pb is disposed slightly to the right (in the drawing) with respect to data lines D1, D2, and D3, the following results in their coupling capacitance values: Ca-d1 >Ca-d2 and Cb-d2<Cb-d3. Here, Ca-d1 and Ca-d2 are the coupling capacitances between the pixel electrode Pa and the data lines D1 and D2, respectively, and Cb-d2 and Cb-d3 are the coupling capacitances between the pixel electrode Pb and the data lines D2 and D3, respectively.

Figure 8:
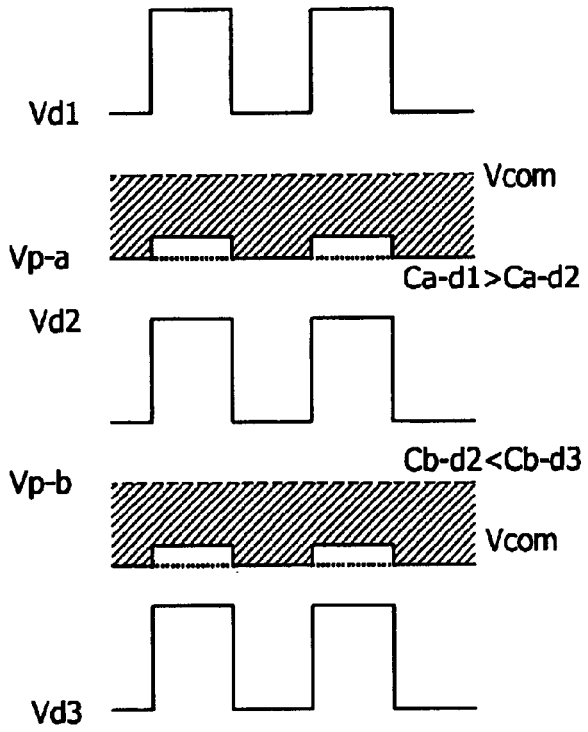
FIG. 8 is a view illustrating fluctuations in voltage with respect to time when the pattern shown in FIG. 7 is driven using the inventive inversion method.

FIG. 8 shows a view illustrating fluctuations in voltage with respect to time when inversion drive according to the present invention is performed on the pattern shown in FIG. 7. Here, it is assumed that pixel voltage is influenced more by data voltage with a larger coupling capacitance.

Accordingly, as Ca-d1>Ca-d2, more influence is given to pixel voltage Vp-a of the pixel Pa by Vd1 than Vd2 such that Vp-a is pulled upward (in the drawing) as a result of Vd1 and Vd2 moving in an identical phase. Further, as Cb-d2<Cb-d3, more influence is given to pixel voltage Vp-b of the pixel Pb by Vd3 than Vd2 such that Vp-b is pulled upward (in the drawing) as a result of Vd3 and Vd2 moving in an identical phase.

Namely, the pixels Vp-a and Vp-b do not result in the dotted line shown in FIG. 8, but as they are shifted in an identical direction by coupling capacitance, a root mean square (RMS) of two adjacent pixels becomes nearly identical. Accordingly, a difference in brightness of adjacent pixels (i.e. between pixels in the RGB groups) is not like that in the prior art.

Figure 9:
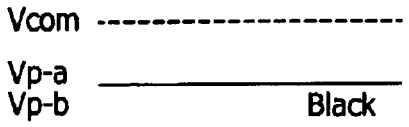
FIG. 9 illustrates data voltage applied to pixels shown in FIG. 7 when the same are in a normal state and when the same have been shortened.

Further, according to the inversion driving method of FIGS. 6*a* and 6*b,* as shown in FIG. 9, Vp-a and Vp-b become negative values against common voltage (Vcom) in a normal state such that a black state is displayed. In addition, as Vp-a and Vp-b become negative values even if electrodes of two adjacent pixels are shortened, a black state is displayed as in a normal state. Accordingly, in the inventive LCD, pixels do not become defective to display a white state even when two adjacent pixels are shortened.

In FIGS. 6*a* and 6*b,* although the number of pixels in the pixel group is three, the number of pixels in the pixel group is not limited to three.

Further, in the inventive LCD, although a difference in brightness results between adjacent pixels of differing RGB groups from coupling capacitances as in the prior art dot and column inversion driving methods, in addition to pixel defects resulting from the shortening of pixels, the possibility of such problems are reduced to one-third in the present invention.

Figure 10:
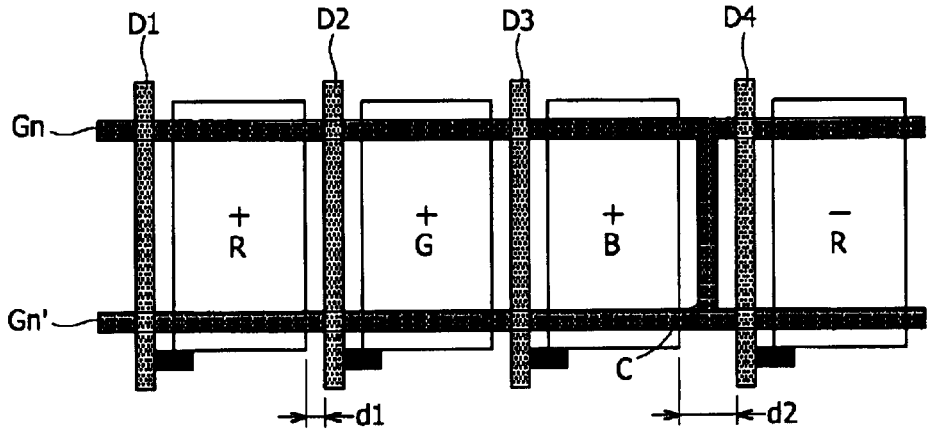
FIG. 10 is a view illustrating a pixel structure according to a preferred embodiment of the present invention.

Accordingly, to prevent the above problems of brightness discrepancies between adjacent pixels of differing RGB groups and pixel defects, an inventive pixel structure is provided as shown in FIG. 10.

In the drawing, a sufficient distance d2 is provided between a blue (B) pixel electrode and a data line D4 provided to the right (in the drawing) of the same pixel electrode, while a distance d1 between data lines D1, D2, and D3 and red (R), green (G), and blue (B) pixel electrodes is maintained as short as possible.

A longer distance d2 between the blue (B) pixel electrode and the data line D4 (before the next group of RGB pixels) reduces coupling capacitance between these two elements, which reduces brightness difference caused by coupling capacitance and minimizes the possibility that adjacent pixels of two RGB groups are shortened. Also, the sufficient distance d2 between the RGB pixel groups makes it easier to repair shortening defects with a laser.

However, because such a large interval between a pixel and data line reduces an aperture ratio, only one pixel electrode out of each RGB group of three pixels has this long distance d2 with a data line, while the remaining two pixels keep the short distance d1 with the data lines. According to the present invention, it is preferable that the distance d2 is two to six times longer than the distance d1, more preferably four times longer.

When two gate lines, a first gate line Gn and a second gate line Gn', are provided, a connecting member C formed between the gate lines Gn and Gn' may further prevent brightness difference caused by coupling capacitance between adjacent pixels of different RGB groups.

In more detail, because gate OFF voltage, generally lower than data voltage, is mainly applied to the connecting member C, the pixel electrode and the data line D4 are electrically shielded and reduce the coupling capacitance, thereby preventing brightness difference between pixels. Here, it is preferable that the connecting member C is interposed between two pixels of different RGB groups.

The above method of disposing a connecting member between gate lines and between adjacent pixel electrodes of different groups to prevent differences in pixel brightness can also be applied to an in-plane switching (IPS) mode.

Figure 11:
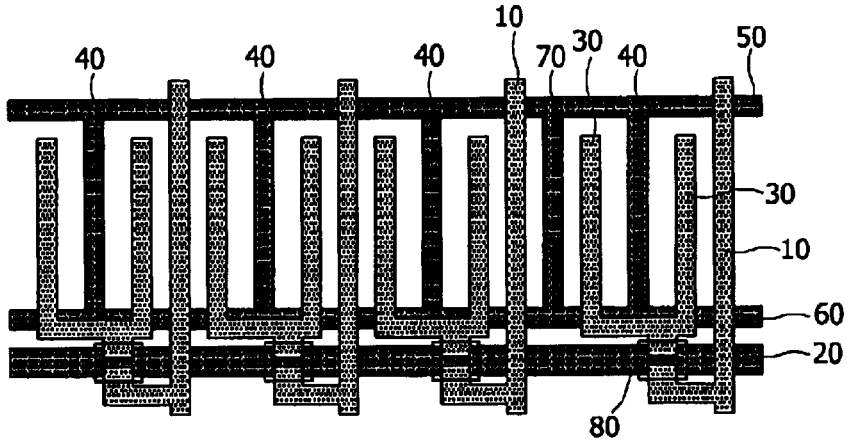
FIG. 11 is a modified example of the pixel structure shown in FIG. 10 in which an in-plane switching mode is applied.

FIG. 11 shows a modified example of the pixel structure shown in FIG. 10 in which the IPS mode is applied. As shown in the drawing, a TFT 80 having a source electrode, a drain electrode, and a gate electrode is provided near each of the intersection of data lines 10 and gate line 20, and two pixel electrodes 30 are merged and connected to each of the drain electrodes of the TFTs 80. A first common line 50 and a second common line 60 are arranged parallel to the gate line 20, and common electrodes 40 connect the first common line 50 and the second common line 60. The common electrodes 40 are positioned between each pair of pixel electrodes 30.

A connecting member 70 is further provided between the first and second common lines 50 and 60, at a location where pixel electrodes 30 of different RGB groups are adjacent. The connecting member 70, as in the pixel structure shown in FIG. 10, provides electrical shielding between the pixel electrodes 30 and data lines 10. Namely, as common voltage is applied to the connecting member 70, coupling capacitance is reduced between the pixel electrodes 30 and data lines 10 such that differences in brightness between pixels of different groups is prevented. Here, it is preferable that the connecting member is interposed between two pixels of different RGB groups.

In the present invention, differences in brightness between adjacent pixels, caused by coupling capacitance between pixel electrodes and adjacent data lines, is reduced, and pixel defects caused by the shortening of two pixels is prevented.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A method for driving a liquid crystal display having a plurality of gate lines and data lines intersecting each other, a matrix of a plurality of pixels, each pixel including a pixel electrode, a common electrode extended to each pixel, comprising steps of:

dividing the plurality of pixels into a plurality of pixel groups, each pixel group comprising a plurality of pixels adjacent to each other;

applying a common voltage to the common electrode; and applying a data voltage of a positive polarity or a negative polarity with respect to the common voltage alternately to each pixel group per frame, wherein the polarity of the data voltage applied to the pixels in the same pixel group is the same, and a first distance between a first data line for a first pixel electrode of a first pixel group and a second pixel electrode of a second pixel group neighboring the first data line is greater than a second distance between a second data line for the second pixel electrode and a third pixel electrode of the second pixel group neighboring the second data line.

2. The method according to claim 1, wherein each pixel group comprises three pixels.

3. The method according to claim 2, wherein each pixel group comprises a red pixel, a green pixel, and a blue pixel.

4. The method according to claim 1, wherein data voltages having the same polarity with respect to the common voltage are applied to the adjacent pixels in the same column.

5. The method according to claim 1, wherein data voltages having different polarities with respect to the common voltage are applied to the adjacent pixels on the same column.

6. A liquid crystal display (LCD), comprising:

a substrate;

a plurality of gate lines formed on the substrate;

a plurality of data lines insulated from and intersecting the gate lines and transmitting a data voltage; and a plurality of pixels formed corresponding to respective regions defined by the data lines and the gate lines, the plurality of pixels being divided into a plurality of pixel groups, each pixel group comprising two or more pixels, each pixel including a pixel electrode, wherein a common voltage is applied to the plurality of pixels, and polarities of the data voltage with respect to the common voltage are inverted in a unit of a pixel group per frame, and a first distance between a first data line for a first pixel electrode of a first pixel group and a second pixel electrode of a second pixel group neighboring the first data line is greater than a second distance between a second data line for the second pixel electrode and a third pixel electrode of the second pixel group neighboring the second data line.

7. The LCD according to claim 6, wherein each pixel group comprises three pixels.

8. The LCD according to claim 7, wherein each pixel group comprises a red pixel, a green pixel, and a blue pixel.

9. The LCD according to claim 6, wherein the first distance is two to six times greater than the second distance.

10. The LCD according to claim 9, wherein the first distance is four times greater than the second distance.

11. The LCD according to claim 6, wherein the gate lines are divided into gate line groups, each gate line group comprising a first gate line, a second gate line adjacent to the first gate line, and a connecting member coupled between the first gate line and the second gate line.

12. The LCD according to claim 11, wherein the connecting member is interposed between pixels of different pixel groups.

13. The LCD according to claim 6, wherein the common voltage is applied through a common electrode formed on the substrate.

14. The LCD according to claim 13, wherein a plurality of common lines are connected to the common electrode, and the plurality of common lines are divided into a plurality of common line group, each common line group comprising a first common line, a second common line, and a connecting member coupled between the first common line and a second common line.

15. The LCD according to claim 14, wherein the connecting member is interposed between pixels of different pixel groups.

16. The method according to claim 1, wherein the pixel group comprises a column of red pixels, a column of green pixels and a column of blue pixels.

17. A liquid crystal display (LCD), comprising:

a substrate;

a plurality of gate lines formed on the substrate;

a plurality of data lines insulated from and intersecting the gate lines and transmitting a data voltage; and a plurality of pixels formed corresponding to respective regions defined by the data lines and the gate lines, the plurality of pixels being divided into a plurality of pixel groups, at least one of the pixel groups comprising two or more pixels, wherein each pixel comprises a thin film transistor and a pixel electrode connected to the thin film transistor, wherein a common voltage is applied to the plurality of pixels, and polarities of the data voltage with respect to the common voltage are inverted in a unit of pixel group per frame, and a first distance between a first data line for a first pixel electrode of a first pixel group and a second pixel electrode of a second pixel group neighboring the first data line is greater than a second distance between a second data line for the second pixel electrode and a third pixel electrode of the second pixel group neighboring the second data line.

18. The LCD of claim 17, wherein adjacent two pixels in a column direction have different polarities of the data voltage with respect to the common voltage.

19. The LCD of claim 17, further comprising a plurality of common electrodes formed on the substrate, wherein the pixel electrodes are formed on the common electrodes.

20. The LCD of claim 19, wherein the common electrode is parallel to the pixel electrode.

21. The LCD of claim 20, each common electrode is arranged between two adjacent pixel electrodes.

* * * * *